United States Patent [19]

Smith et al.

[11] 3,958,748

[45] May 25, 1976

[54] RECLOSABLE CARTON

[75] Inventors: William Andrew Smith, Cheviot; Richard Eugene Moyer, Cincinnati, both of Ohio

[73] Assignee: The Procter & Gamble Company, Cincinnati, Ohio

[22] Filed: Nov. 11, 1975

[21] Appl. No.: 630,866

[52] U.S. Cl. ..... 229/51 TC; 229/51 D; 229/17 R; 222/541

[51] Int. Cl.[2] ..... B65D 5/54; B65D 5/70; B65D 17/00

[58] Field of Search ..... 229/51 TC, 51 WB, 51 SC, 229/51 D, 17 R, 7 R; 222/153, 541

[56] References Cited

UNITED STATES PATENTS

| | | | |
|---|---|---|---|
| 1,746,006 | 2/1930 | Metzger | 229/51 D X |
| 1,980,851 | 11/1934 | Crawford | 229/51 TC |
| 2,789,746 | 4/1957 | Houland | 229/51 TC X |
| 3,185,578 | 5/1965 | Scharre | 229/51 D X |
| 3,269,635 | 8/1966 | Bergstein et al. | 229/51 SC X |
| 3,301,391 | 1/1967 | Guyer | 229/51 TC X |
| 3,361,327 | 1/1968 | Waldrop | 229/51 TC X |
| 3,491,937 | 1/1970 | Brastad | 229/51 TC |
| 3,595,466 | 7/1911 | Rosenburg, Jr. | 229/51 TC X |

FOREIGN PATENTS OR APPLICATIONS

| | | | |
|---|---|---|---|
| 10,353 | 8/1956 | Germany | 229/51 TC |

*Primary Examiner*—Davis T. Moorhead
*Attorney, Agent, or Firm*—Elliot A. Lackenbach; John V. Gorman; Richard C. Witte

[57] ABSTRACT

Folded paperboard carton provided at one end with opposed pairs of major and minor flaps and an elongated tearout tab having a free edge extending along a major portion of the distal edge of the first down major flap and an opposed concomerated edge connection therewith to provide a wide opening; enabling removal of a wide rigid premium such as a children's book or a record as well as enabling well controlled pouring of a product such as a granulated detergent, while leaving spaced apart minor portions of said distal edge on each side of said major portion adhered to the underlying minor flap to define a U-shaped flange around the opening to allow adequate sealing and to keep the carton generally rigid and resistant to bulging after opening; and wherein the second down major flap is adhered to the first down major flap proximally of said tearout tab substantially only adjacent the concamerated edge thereof; the distal edge of the second down major flap defining a reclosure tab for insertion into a mating slit provided in the first down major flap proximally of said tear out tab and generally parallel said distal edge to enable good reclosure after opening. The concamerated edge may be curvilinearly arched or may be defined by concatenated straight line segments and the tear out tab may be either sealed to the last down major flap for automatic removal from the opening upon lifting of the last down major flap by the consumer or may be release coated to preclude such adherence for manual removal after the last down major flap has been lifted.

14 Claims, 6 Drawing Figures

RECLOSABLE CARTON

FIELD OF THE INVENTION

This application relates generally to paperboard cartons and, more particularly, to a reclosable paperboard carton.

As used herein, the term "paperboard" is intended to be read in its broad and generally accepted sense and not restrictively, and to include materials such as fiberboard, cardboard, boxboard, and the like, as well as substitutes therefor such as laminated or foamed plastic sheets, and the like.

OBJECTS OF THE INVENTION

It is a primary object of the present invention to provide a paperboard carton end construction which is economical to manufacture and assemble; which effectively prevents sifting of product outwardly therefrom during shipping; which is easily openable by the consumer to provide a large unobstructed opening from which granulated product may be readily poured; which yet retains carton shape and rigidity after opening so that bulge is eliminated or substantially reduced; and which can be readily reclosed, as to reduce moisture pickup and product spillage.

Another primary object in the present invention, in addition to the foregoing object, is the provision of such carton which allows the consumer to remove from a box of powdered detergent, or the like, a wide rigid premium, such as a child's book, a record, or the like.

Yet another primary object of the present invention, in addition to each of the foregoing objects, is the provision of such a carton which may be sealed inexpensively, as with dextrin glue and which is yet easily openable and reclosable by the consumer.

Yet still another primary object of the present invention, in addition to each of the foregoing objects, is the provision of a premium-containing carton which is sift proof, runnable on high speed packing lines with inexpensive adhesive such as dextrin glue, is easy to open, provides access to a rigid premium which is only slightly less wide than the carton and keeps the carton from bulging excessively, while still allowing good product pouring control and providing good reclosability.

The invention resides in the combination, construction, arrangement and disposition of the various component parts and elements incorporated in new and improved reclosable cartons constructed in accordance with the principles of this invention. The present invention will be better understood and objects and important features other than those specifically enumerated above will become apparent when consideration is given to the following details and description which, when taken in conjunction with the annexed drawing describes, discloses, illustrates and shows certain preferred embodiments or modifications of the present invention and what is presently considered and believed to be the best mode of practicing the principles thereof. Other embodiments or modifications may be suggested to those having the benefit of the teaching herein, and such other embodiments or modifications are intended to be expressly reserved, especially as they fall within the scope and spirit of the subjoined claims.

SUMMARY OF THE INVENTION

In accordance with the present invention there is provided a folded paperboard carton provided at one end with opposed pairs of major and minor flaps and an elongated tearout tab having a free edge extending along a major portion of the distal edge of the first down major flap and an opposed concomerated edge connection therewith to provide a wide opening; enabling removal of a wide rigid premium such as a children's book or a record as well as enabling well controlled pouring of a product such as a granulated detergent, while leaving spaced apart minor portions of said distal edge on each side of said major portion adhered to the underlying minor flap to define a U-shaped flange around the opening to allow adequate sealing and to keep the carton generally rigid and resistant to bulging after opening; and wherein the second down major flap is adhered to the first down major flap proximally of said tearout tab substantially only adjacent the concamerated edge thereof; the distal edge of the second down major flap defining a reclosure tab for insertion into a mating slit provided in the first down major flap proximally of said tear out tab and generally parallel said distal edge to enable good reclosure after opening. The concamerated edge may be curvilinearly arched or may be defined by concatenated straight line segments and the tear out tab may be either sealed to the last down major flap for automatic removal from the opening upon lifting of the last down major flap by the consumer or may be release coated to preclude such adherence for manual removal after the last down major flap has been lifted.

DESCRIPTION OF THE DRAWING

While the specification concludes with claims particularly pointing and distinctly claiming the subject matter which is regarded as forming the present invention, it is believed the invention will be better understood from the following detailed description when taken in conjunction with the annexed drawing which discloses, illustrates, and shows certain preferred embodiments or modifications of the present invention and what is presently considered and believed to be the best mode of practicing the principles thereof and wherein:

DETAILED DESCRIPTION OF THE INVENTION

Figure 1:
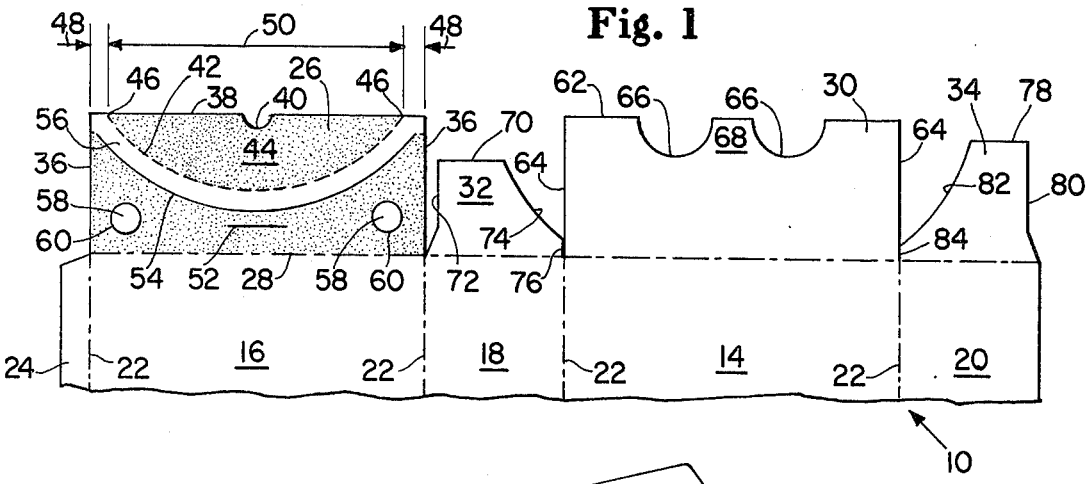
FIG. 1 is a plan view of the top portion of a carton blank in accordance with the present invention.

As has heretofore been pointed out, the present invention pertains to a reclosable top structure for a paperboard carton. The bottom closure structure of the carton does not form a part of the present invention and, accordingly, has not been shown and illustrated in the drawing as it can be of any desired convention construction utilizing, for example, overlapping and glued generally rectangular major and minor flaps.

Figure 2:
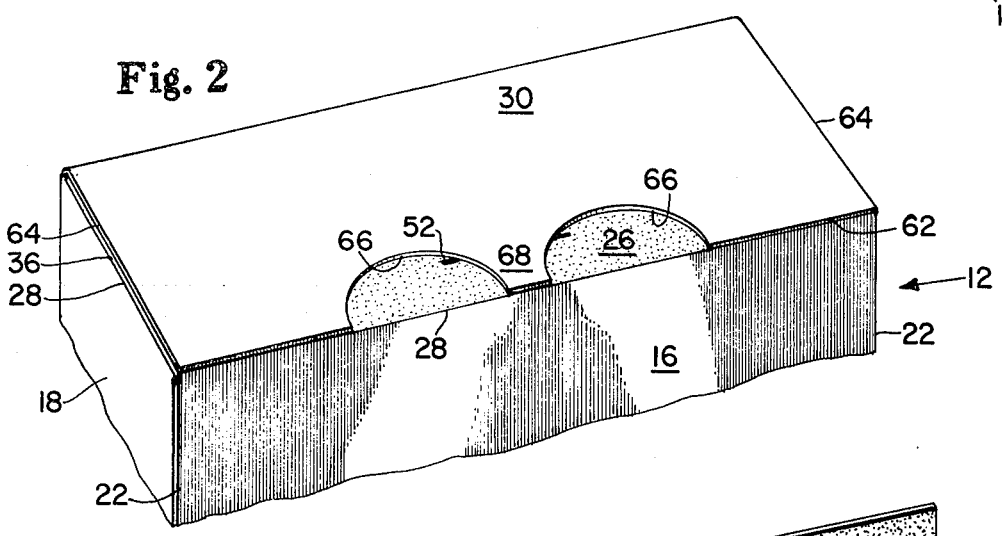
FIG. 2 is a pictorial illustration of a sealed carton top in accordance with the present invention on a larger scale.
Figure 3:
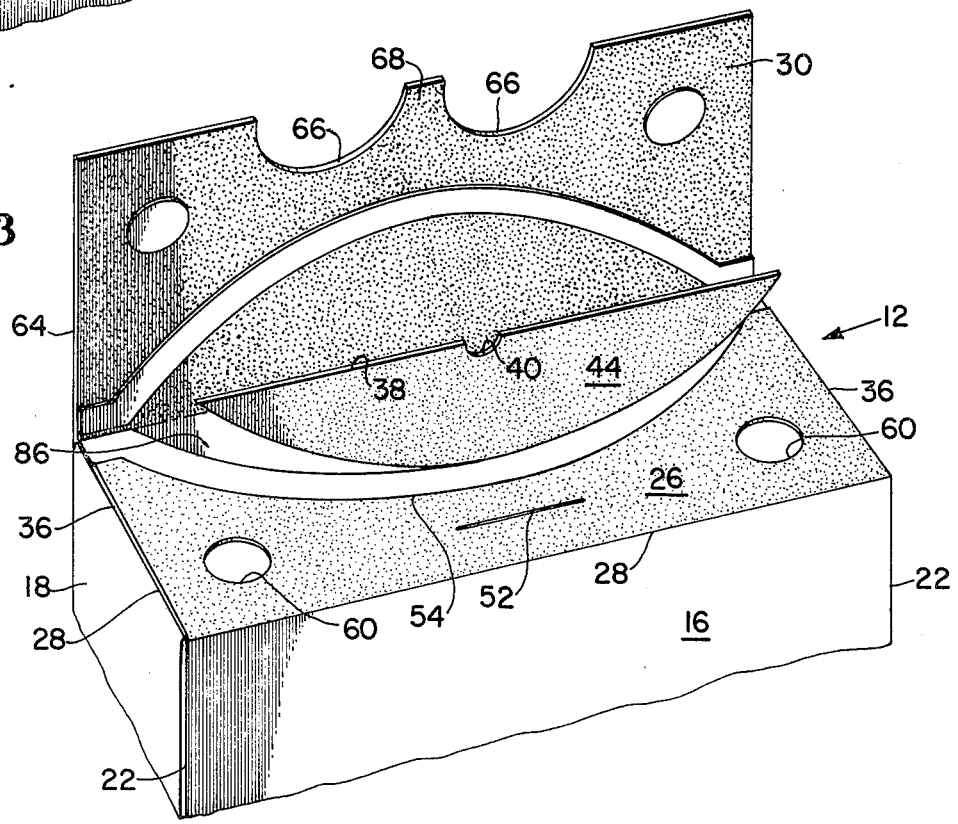
FIG. 3 is a pictorial illustration showing how the carton top of the present invention is opened for use.

With reference now to the drawing, and particularly to FIGS. 1–3 thereof there is shown and illustrated therein the top portion of a carton blank generally designated by the reference character 10 which can be erected and glued to form a generally rectangular carton 12.

The blank 10 comprises a back panel 14, a front panel 16, and two side panels 18 and 20 serially connected along parallel crease lines 22. A gluing flap 24 is also connected to the front panel 16 along a crease line 22. A top panel 26 is connected to the top of the front panel 16 along a transverse crease line 28 and defines the first down major flap. A closure panel 30 is connected to the back panel 14 along the crease line 28 to define the last down major flap. Top side panels 32 and 34 are connected with the side panels 18 and 20 along the transverse crease line 28 to define minor flaps.

The first down major flap 26 is defined by side edges 36 and distal edge 38, the distal edge 38 being provided with a generally arcuate medially positioned inwardly extending finger notch 40. The first down major flap 26 is also provided with a generally concamerated line of concatenated perforations 42 extending generally curvilinearly inwardly from spaced apart locations on distal edge 38 to define the opposite edge of a removable elongated concamerated tear out tab 44 extending along a major extent of the distal edge 38 of the first down major flap 26 and containing therein the notch 40.

As indicated, the concamerated line of concatenated perforations 42 extend between spaced apart locations, designated by the reference character 46, on the distal edge 38 of the first down major flap 26. The locations 46, accordingly, are each respectively spaced apart from the adjacent side edge 36 a distance designated 48 and are spaced apart from each other by a distance designated 50.

The first down major flap 26 is also provided with an elongated slit 52 for permitting reclosure, in a manner to be hereinafter described. The slit 52 is generally parallel the crease line 28 and the distal edge 38, generally opposite the notch 40 and generally intermediate the line of perforations 42 and the crease line 28. Yet further, the first down major flap 26 is provided with a concamerated top liner cut 54 parallel and generally uniformly spaced apart from the line of perforations 42 and disposed between the line of perforations 42 and the crease line 28. The top liner cut 54 extends only part way into the flap 26 and provides clean tearing when the carton is opened. Between the line of perforations 42 and the top liner cut 54 there is defined a generally longitudinally extensive fornix region 56 which, as will be explained hereinafter, defines the major or primary attachment and sealing between the first down major flap 26 and the last down major flap 30. A pair of smaller and generally circular regions 58 are also defined, as by means of generally circular top liner cuts 60 adjacent the crease line 28 and on opposite sides of the slit 52. The regions 58 provide secondary sealing, in a manner to be hereinafter described, between the first down major flap 26 and the last down major flap 30. The generally circular top liner cuts 60, similarly to the generally top liner cuts 54, extend only partially into the first down major flap 26, provide clean tearing and prevent "onion peeling" when the carton is opened.

The outer surface (shown in FIG. 1) of the first down major flap 26 is further provided, except in the regions 56 and 58, with a release coating (indicated by the speckled shading) to prevent adhesion thereat between the outer surface of the first down major flap 26 and the inner surface of the last down major flap 30 during gluing of the carton. For example, and by way of illustration only, a dextrin adhesive such as Staylex 52B supplied by A. E. Staley Manufacturing Co. of Decatur, Illinois may be used to seal the carton and the release coating on the outer surface of the first down major flap 26 may comprise a clear lacquer such as Krylon 1325 or 1302 supplied by Borden, Inc. of Columbus, Ohio.

Other glues or adhesives as well as other release coatings, lacquers, varnishes, and the like may be used as will be apparent to those skilled in the packaging art. If desired, the release coating may be dispensed with and the adhesive applied to correspond only to the regions 56 and 58.

The last down major flap 30 is defined by a distal edge 62 generally parallel and spaced apart from the crease line 28 and a pair of side edges 64. The distal edge 62 is provided with a pair of sapced apart generally arcuate notches 66 defining therebetween a reclosure tab 68 adapted to be inserted through the slit 52 for reclosure of the container 12 by the consumer after opening.

The minor or side flap 32 is defined by a distal edge 70 generally parallel and spaced apart from the crease line 28, a generally straight side edge 72 and a generally notched side edge 74 having a curvature which is preferably generally equal to the curvature of the line of perforation 42 to provide maximum sealing of the carton and support of the carton mouth to preclude bulging thereof after opening, although a larger curvature may be used. The side edge of the minor flap 32 defined primarily by the notched edge 74 is further defined by a generally perpendicular edge portion 76 having a length preferably substantially equal to the distance 48 with the notched edge 74 departing therefrom at an angle which is preferably substantially identical to the departure of the line of perforation 42 from the distal edge 38 of the first down major flap 26.

The minor flap 34 is similarly defined by a distal edge 78, a side edge 80, notched te edge portion 82 and a perpendicular edge portion 84. The notched edge portion 82 and the perpendicular edge portion 84 are similar to the notched edge portion 74 and the perpendicular edge portion 76.

The erection and sealing of the carton may now be described. The gluing flap 24 is generally first glued to the side panel 20, the carton blank 10 being folded along the crease lines 22. In accordance with conventional practice, the gluing flap 22 is generally glued to the side panel 20 at the time of carton blank manufacture and the glued carton blank then shipped to a filling location in a flat condition. At the filling location, the carton is erected and filled and the flaps are sealed. For example, the side or minor flaps 32 and 34 may first be folded down and an adhesive, such as Staylex 52B wiped onto the inner surfaces of both major flaps 26 and 30. The first down major flap 26 is then folded down on top of the minor or side flaps 32 and 34 and the last down major flap 30 is then folded on top thereof. At this point, the top of the carton is closed and completely sealed as shown in FIG. 2. The upper surfaces of the side or minor flaps 32 and 34 are glued to the lower surface of the first down major flap 26 with the arcuate edge portions 74 and 82 of the side or minor flaps 32 and 34, respectively, generally aligned with the arcuate line of perforation 42. A generally rigid and sift proof U-shaped frame is therefore defined by the side or minor flaps 32 and 34 as glued to the first down major flap 26 between the arcuate line of perforation 42 and the crease line 28 and along the side edges 36.

The last down major flap 30 is glued to the first down major flap 26 along the fornix region 56 and to circular regions 58. Since the fornix region 56 extends inwardly along the distal edge 38 the distances 48, complete sift free sealing is accomplished and the circular spots 58 hold the corners of the last down major flap 30 in position.

The carton is normally filled in an inverted position. The product (which may, for example, comprise a granulated detergent, or the like) is then added through the open bottom and the bottom flaps sealed.

The carton may be opened by the consumer by peeling the last down major flap 30 upwardly as shown in FIG. 3. The circular top liner cuts 60 and the concatenated line of perforations 42 enable the top layer of paperboard within the circular regions 58 and the fornix region 56 to be peeled from the first down major flap 26 to remain adhered to the second down major flap 30 while precluding "onion peeling" beyond these regions. The concamerated tear out tab 44 may then be readily removed by the notch 40 and along the line of perforation 42 and discarded to thereby define a generally elongated opening 86 through which product may be readily poured in a well controlled manner from either end. Additionally, a large rigid premium, such as a children's book, a record, or the like, may be readily removed outwardly therethrough. The rigid generally U-shaped frame formed by the side or minor flaps 32 and 34 together with the remaining portion of the first down major flap 26 provides sufficient rigidity to prevent or substantially reduce bulging of the open carton after opening.

Reclosure can be readily effected by the consumer by inserting the tab 68 downwardly into the slot 52 to thereby hold the flap 30 closely superposed on flap 26.

Figure 4:
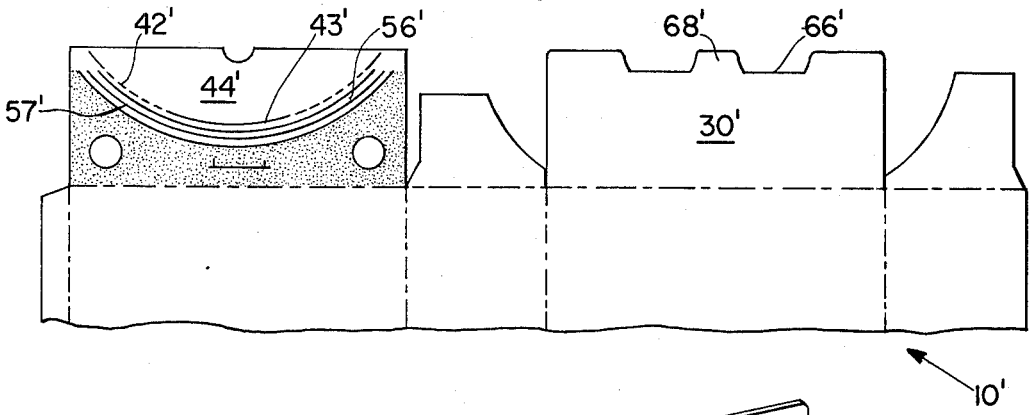
FIG. 4 is a plan view similar to FIG. 1 of another carton blank in accordance with the present invention.
Figure 5:
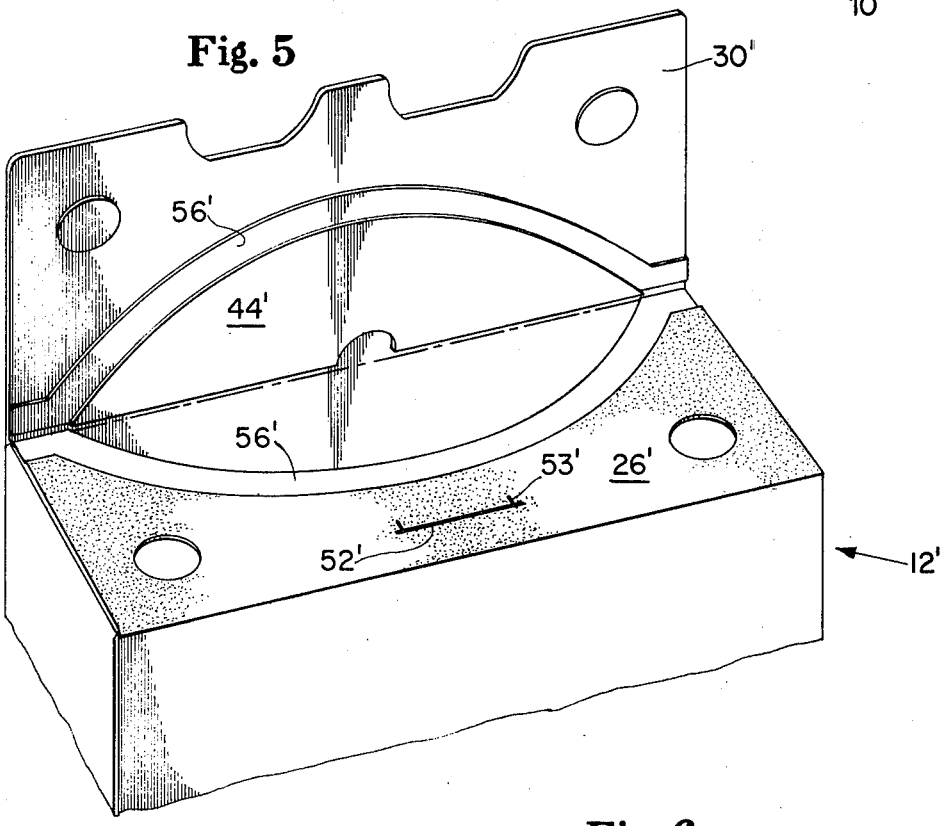
FIG. 5 is a pictorial illustration similar to FIG. 3 of the carton top formed from the blank of FIG. 4 after sealing and opening thereof.
Figure 6:
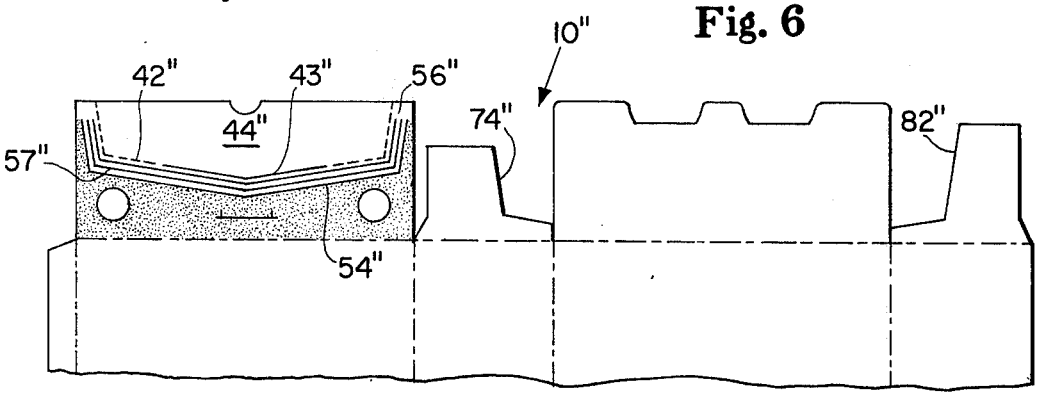
FIG. 6 is a plan view of the top portion of yet another carton blank in accordance with the present invention.

With reference now to FIGS. 4, 5 and 6 there are shown and illustrated carton blanks designated generally by the reference characters 10' (FIG. 4) and 10'' (FIG. 6) that can be assembled, respectively, into a carton designated generally by the reference character 12' (FIG. 5) and into a carton (not shown) in accordance with other embodiments or modifications of the present invention. In the drawing, FIGS. 4, 5 and 6, and in the ensuing description, like reference characters will be utilized as were utilized in connection with the embodiment or modifications shown in FIGS. 1–3 and hereinbefore described for like component parts and elements, except that in reference to the embodiment or modification of FIGS. 4 and 5 the reference characters are primed and that in reference to the embodiment or modifications of FIG. 6 the reference characters are double primed. In addition, only those details which have been modified or changed from the embodiment or modification shown and illustrated in FIGS. 1 and 3 hereinbefore described will be discussed hereinafter in detail, the remainder of the previously detailed disclosure of the embodiment or modification of FIGS. 1–3 being specifically applied to the embodiments or modifications of FIGS. 4–5 as fully and completely as herein repeated.

In the embodiment or modification of the carton blank 10' and carton 12' shown and illustrated in FIGS. 4 and 5, the tear out tab 44' has been designed to adhere to the last down major flap 30' to be automatically torn from the first down major flap 26' upon lifting of the last down major flap 30' by the consumer. To this end, the outer surface of the tear out tab 44' has been left free of release coating or hold-out lacquer so that upon assembly of the carton, glue will adhere thereto sealing the tear out tab 44' to the inner surface of the last down major flap 30'. In addition, to make separation of the tear out tab 44' from the remainder of the first down major flap 26' more easy and positively accomplished, the concatenated line of perforations 42' includes a generally centrally oriented curvilinear elongated continuous cut portion 43'. Hence, the nose portion of the tear out tab 44' (defined by the curvilinear continuous cut 43') is free of the adjacent portion of the fornix portion 56' and upon lifting of the last down major flap 30' will readily bend upwardly and be released from its alignment within the plane of the fornix portion 56'. This will cause a high stress concentration upon the adjacent concatenated perforations of the line of perforations 42' and easy serial breaking thereof and separation of the tear out tab 44' from the first down major flap 26'.

To further aid in the prevention of "onion peeling" and in order to weaken the top liner in the fornix region 56', supplementary top liner cuts 57' have been provided. Such supplemental top liner cuts could, of course, be provided in the embodiment of FIGS. 1–3 and extend only into the top liner, that is, only part way into the board defining the first down major flap 26'.

As a further modification, the notches 66' still have arcuate side edge portions but have been made less deep than the notches 66 of the embodiment or modification of FIGS. 1–3 and limited by a bottom chordal edge so that while the notches 66' still define the reclosure tab 68', additional strength is obtained through additional board area at the bottom of the notches. Further, the slit 52' has also been modified from the slit 52 of the embodiment or modification of FIGS. 1–3 by adding two small perpendicular cuts 53' located towards each end of the slit 52' to make it easier to insert the reclosure tab 68'. again, these changes could be incorporated into the embodiment or modification of FIGS. 1–3.

As hereinbefore pointed out, the concamerated tear out tab and the fornix region can be defined by concatenated slits or perforations extending along a curvilinear path or by a concatenated series of elongated straight line segments. By way of example, and referring now to FIG. 6, there is shown and illustrated the top portion of yet another carton blank designated generally by the reference character 10'' in accordance with the present invention wherein the tear out tab 44'' and the adjacent fornix region 56'' defined by concatenated linear segmental lines of perforation 42'' and continuous cuts 43'' between the tear out tab 44'' and the fornix region 56'' and a generally parallel concatenated continuous top liner cut 54''. Supplemental top liner cuts 57'' may also be provided. The notched edges 74'' and 82'' are defined by similar concatenated cut segments. The end portion of the dispensing opening thereby formed, therefore are wider.

While the invention has been described, disclosed, illustrated and shown in terms of certain embodiments or modifications which it has assumed in practice, such other embodiments or modifications as may be suggested to those having the benefit of the teachings herein are intended to be expressly reserved especially as they fall within the scope and the breadth of the claims here appended.

What is claimed is:

1. In a folded board carton provided at one end with opposed pairs of major and minor flaps, the improvement comprising an elongated concamerated tear out tab extending inwardly of a major extent of the distal edge of the first down major flap leaving a minor portion of said distal edge on each side of said major portion to allow adequate sealing and to keep the carton generally rigid and bulge resistant after opening and wherein the second down major flap is adhered to said first down major flap proximally of said tear out tab substantially only adjacent the concamerated edge thereof; the distal edge of said second down major flap defining a reclosure tab for insertion into a mating slit provided in said first down major flap to enable reclosure thereof after opening.

2. Folded carton defined in claim 1 wherein said tear out tab is defined by concatenated line of perforations extending between locations spaced apart along said distal edge of said first down major flap and spaced apart from the side edges of said first down major flap.

3. Folded carton defined in claim 2 wherein side line of perforations is generally continuously curvilinear.

4. Folded carton defined in claim 2 wherein said line of perforations comprises a generally elongated medial continuous cut.

5. Folded carton defined in claim 2 wherein said line of perforations comprises a series of concatenated elongated straight line cuts.

6. Folded carton defined in claim 2 wherein said tear out tab is coated with a release coating to prevent adherence thereof to said second down major flap and provided with a finger notch extending generally medially inwardly from said distal edge thereof to enable manual removal thereof following consumer lifting of said second down major flap.

7. Board carton defined in claim 1 wherein said reclosure tab is defined by a pair of spaced apart notches having generally arcuate side edges provided extending inwardly of the distal edge of said second down major flap.

8. Folded carton defined in claim 1 wherein said first down major flap is provided with a patterned coating of hold out lacquer enabling adhesion thereof with said second down major flap primarily along a fornix region extending adjacent the concamerated edge of said tear out flap.

9. Folded carton defined in claim 1 wherein said minor flaps are each provided with generally notched edges in general alignment, when erected, with the concamerated edge of said tear out tab.

10. Folded carton defined in claim 1 wherein said major flaps are adhered together primarily along a fornix region extending adjacent said tear out tab.

11. Folded carton defined in claim 9 wherein said fornix region is of generally uniform width and is defined along one edge by said line of perforation and along the other edge by a concamerated generally continuous top liner cut spaced generally uniformly apart from said line of perforations.

12. Folded carton defined in claim 10 further comprising a series of generally parallel supplemental top liner cuts extending generally longitudinally entirely of and within said fornix region.

13. Folded carton defined in claim 5 further comprising a pair of secondary adhesive spots adhering the distal corner portions of said second down major flap to the subjacent portions of said first down major flap.

14. Folded carton defined in claim 2 wherein said tear out tab is adhered to said second down major flap to be removed from said first down major flap during consumer lifting of said second down major flap.

* * * * *